US009653780B2

(12) United States Patent
Chen et al.

(10) Patent No.: US 9,653,780 B2
(45) Date of Patent: May 16, 2017

(54) ANTENNA MODULE

(71) Applicant: Chiun Mai Communication Systems, Inc., New Taipei (TW)

(72) Inventors: Hsi-Chieh Chen, New Taipei (TW); Cho-Kang Hsu, New Taipei (TW); Chang-Ching Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 243 days.

(21) Appl. No.: 14/014,593

(22) Filed: Aug. 30, 2013

(65) Prior Publication Data

US 2014/0232602 A1 Aug. 21, 2014

(30) Foreign Application Priority Data

Feb. 20, 2013 (TW) ..... 102105807 A

(51) Int. Cl.
*H01Q 1/24* (2006.01)
*H01Q 1/36* (2006.01)

(52) U.S. Cl.
CPC ..... *H01Q 1/243* (2013.01); *H01Q 1/36* (2013.01)

(58) Field of Classification Search
CPC ..... H01Q 1/36; H01Q 1/243
USPC ..... 343/702
See application file for complete search history.

(56) References Cited

U.S. PATENT DOCUMENTS

| | | | | |
|---|---|---|---|---|
| 3,987,448 | A * | 10/1976 | Scheppman | 343/702 |
| 6,348,897 | B1 * | 2/2002 | Alameh et al. | 343/702 |
| 2003/0076268 | A1 | 4/2003 | Tarvas et al. | |
| 2008/0129630 | A1 * | 6/2008 | Baliarda et al. | 343/793 |
| 2010/0039329 | A1 * | 2/2010 | Chen | H01Q 1/38 343/700 MS |
| 2011/0193752 | A1 * | 8/2011 | Wang | H01Q 1/243 343/702 |
| 2012/0206302 | A1 * | 8/2012 | Ramachandran et al. | 343/702 |

FOREIGN PATENT DOCUMENTS

| | | | |
|---|---|---|---|
| CN | 201294259 | Y | 8/2009 |
| EP | 2511979 | A1 | 10/2012 |
| TW | 201128859 | A1 | 8/2011 |

* cited by examiner

*Primary Examiner* — Sue A Purvis
*Assistant Examiner* — Noel Maldonado
(74) *Attorney, Agent, or Firm* — Steven Reiss

(57) ABSTRACT

An exemplary antenna module includes a metal unit, a ground unit, a feed unit, and a resonating unit. The metal unit is a metal housing or a metal sidewall of a wireless communication device. One end of the ground unit is connected to the metal unit and another end of the ground unit is grounded. One end of the feed unit is connected to the metal unit and another end of the feed unit is connected to a feed point of the wireless communication device. The resonating unit and the metal unit cooperatively generate a resonating, thereby receiving/sending wireless signals in corresponding frequency bands.

11 Claims, 2 Drawing Sheets

ANTENNA MODULE

BACKGROUND

1. Technical Field

The disclosure generally relates to antennas, and particularly to an antenna module for wireless communication devices.

2. Description of Related Art

Many wireless communication devices, such as mobile phones, personal digital assistants, and laptop computers often use antennas to receive/send wireless signals.

Generally, the antenna is placed inside the devices, which takes up limited internal space of the wireless communication device, and makes it difficult to miniaturize the wireless communication devices.

In view of the above, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
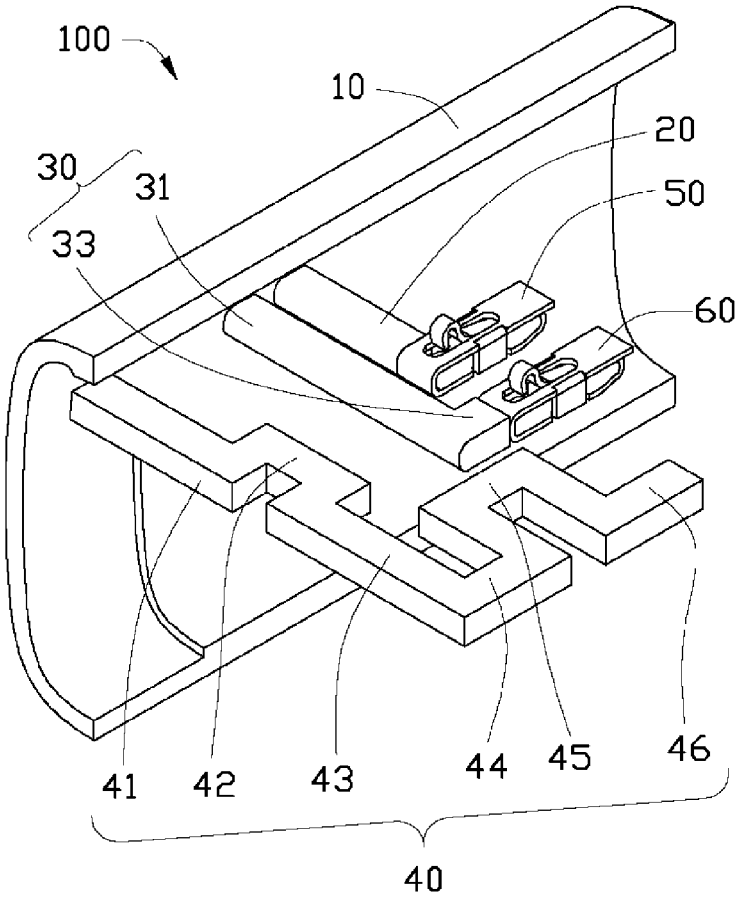
FIG. 1 is a schematic view of an antenna module, according to an exemplary embodiment.

FIG. 1 is a schematic view of an antenna module 100, according to an exemplary embodiment. The antenna module 100 can be applied to a wireless communication device (not shown) to receive/send wireless signals. The wireless communication device may be a portable electronic device such as a mobile phone, a personal digital assistant, or a tablet computer.

The antenna module 100 includes a metal unit 10, a ground unit 20, a feed unit 30, and a resonating unit 40. One end of the ground unit 20 is connected to the metal unit 10. Another end of the ground unit 20 is electronically connected to a ground point of a circuit board (not shown) of the wireless communication device. One end of the feed unit 30 is connected to the metal unit 10. Another end of the feed unit 30 is electronically connected to a feed point of the circuit board (not shown). The resonating unit 40 is electronically connected to the metal unit 10.

When the antenna module 100 is installed, the ground unit 20 can be attached to the ground point to be grounded, the feed unit 30 is connected to the feed point to receive feed signals, and the resonating unit 40 and the metal unit 10 cooperatively form a radiation unit to generate a resonance, thereby receiving/sending wireless signals in corresponding frequency bands. In this embodiment, the antenna module 100 works in a frequency band of global positioning system (1575 MHz).

The metal unit 10 can be a metal housing, such as an outside housing of the wireless communication device or an inside housing of the wireless communication device. The metal unit 10 also may be a metal sidewall of the wireless communication device.

In this embodiment, the antenna module 100 further includes a first elastic sheet 50. One end of the ground unit 20 is connected to the metal unit 10. Another end of the ground unit 20 is connected to the ground point of the circuit board (not shown) by the first elastic sheet 50. Thus, the antenna module 100 can be grounded using the first elastic sheet 50. In this embodiment, the ground unit 20 is perpendicular to the first elastic sheet 50.

The feed unit 30 is substantially L-shape and includes a first feed portion 31 and a second feed portion 33 perpendicular to the first feed portion 31. The antenna module 100 further includes a second elastic sheet 60. One end of the first feed portion 31 is electronically connected to the metal unit 10. The first feed portion 31 is parallel to and adjacent to the ground portion 20. The first feed portion 31 is longer than the ground unit 20. The ground unit 20 and the second feed portion 33 are positioned at a same side of the first feed portion 31. One end of the second feed portion 33 is connected to a part of the first feed portion 31. The second elastic sheet 60 is connected to the second feed portion 33. Thus, the feed unit 30 is connected to the feed point of the circuit board (not shown) by the second elastic sheet 60. Therefore, the antenna module 100 can receive feed signals using the second elastic sheet 60. In this embodiment, the second elastic sheet 60 is positioned at the distal end of the second feed portion 33 and parallel to the first elastic sheet 50.

In this embodiment, the ground unit 20, the feed unit 30, and the resonating unit 40 are positioned in that order and on the same plane.

The resonating unit 40 includes a first resonating portion 41, a second resonating portion 42, a third resonating portion 43, a fourth resonating portion 44, a fifth resonating portion 45, and a sixth resonating portion 46 connected in that order and on the same plane. The first resonating portion 41 is perpendicularly connected to the metal unit 10. The second resonating portion 42 includes a horizontal first main part (not labeled) and two longitudinal first arms (not labeled) respectively perpendicularly connected to two ends of a same side of the first main part. The first main part is positioned to be parallel to the first resonating portion 41 and the two first arms are positioned to be parallel to the metal unit 10. The distal end of one first arm of the second resonating portion 42 is perpendicularly connected to the first resonating portion 41.

The third resonating portion 43 extends away from the distal end of another first arm of the second resonating portion 42 and is positioned to be collinear with the first resonating portion 41. The fourth resonating portion 44 is perpendicularly connected to the distal end of the third resonating portion 43 and parallel to the metal unit 10.

The fifth resonating portion 45 includes a longitudinal second main part (not labeled) and two horizontal second arms (not labeled) respectively perpendicularly connected to two ends of a same side of the second main part. The second main part is positioned to be parallel to the fourth resonating portion 44 and the two second arms are positioned to be parallel to the first resonating portion 41. One second arm of the fifth resonating portion 45 is perpendicularly connected to the distal end of the fourth resonating portion 44. The sixth resonating portion 46 extends away from the distal end of another second arm of the fifth resonating portion 45 and is positioned to be collinear with the fourth resonating portion 44.

Figure 2:
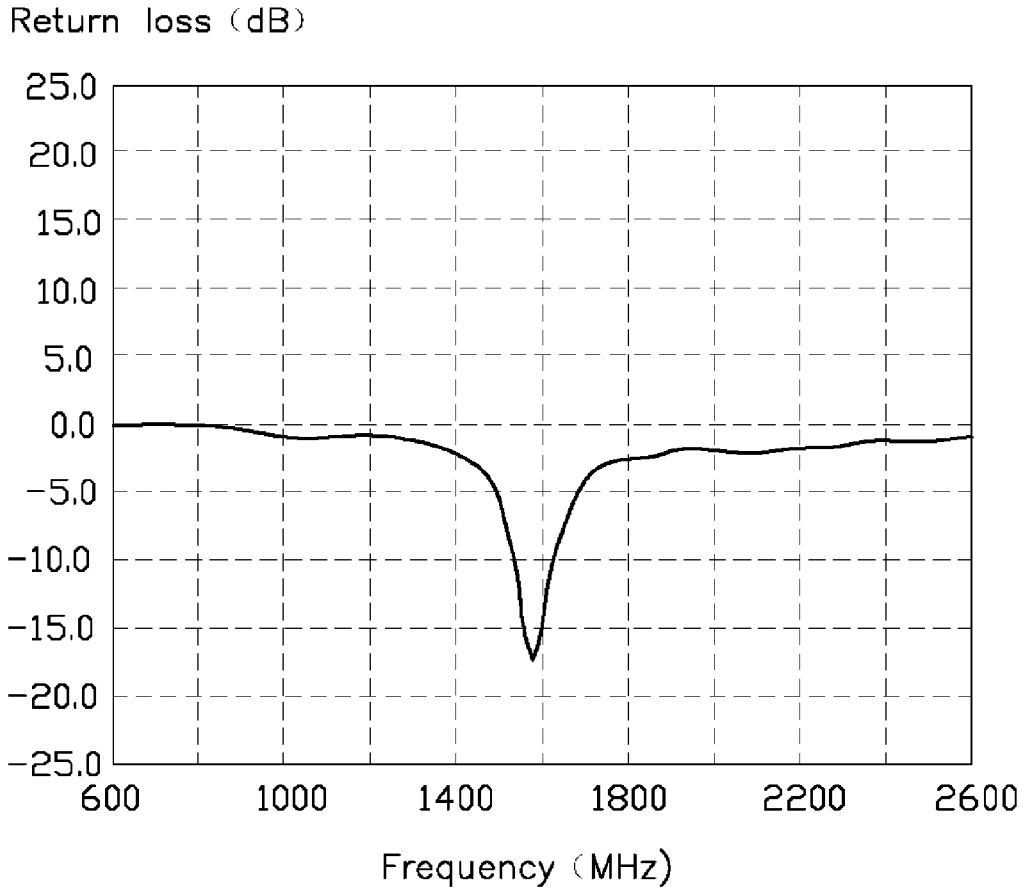
FIG. 2 is a diagram showing a return loss measurement of the antenna module shown in FIG. 1

FIG. 2 is a measurement diagram of return loss (RL) of the antenna module 100. When the antenna module 100 receives/sends wireless signals at frequencies of about 1575 MHz or around about 1575 MHz, the RL of the antenna module 100 is less than −5 dB, and satisfies communication standards.

Also referring to the table 1, as shown in experiments, when the antenna module 100 receives/sends wireless signals of frequencies of about 1575 MHz or around about 1575 MHz, a radiation efficiency is acceptable.

TABLE 1

| Frequency(MHz) | 1555 | 1565 | 1575 | 1585 | 1595 | 1605 |
|---|---|---|---|---|---|---|
| Efficiency (%) | 36 | 37 | 35 | 36 | 38 | 40 |

In summary, the metal unit 10 and the resonating unit 40 cooperatively form a radiator, which can effectively decrease the size of the antenna module 100. Furthermore, when the antenna module 100 is placed inside a wireless communication device, the antenna module 100 takes up a little space of the wireless communication device, thereby making it easy to miniaturize the wireless communication devices.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna module applying in a wireless communication device, the antenna module comprising:

a metal unit, the metal unit being a metal housing or a metal sidewall of the wireless communication device;

a ground unit, one end of the ground unit connecting to the metal unit; another end of the ground unit being grounded;

a feed unit, one end of the feed unit connecting to the metal unit, another end of the feed unit connecting to a feed point of a circuit board of the wireless communication device; and a resonating unit, wherein the resonating unit comprises a first resonating portion, a second resonating portion, a third resonating portion, a fourth resonating portion, a fifth resonating portion, and a sixth resonating portion connected in that order and on the same plane, wherein the first resonating portion is perpendicularly connected to the metal unit, the second resonating portion comprises a horizontal first main part and two longitudinal first arms respectively perpendicularly connected to two ends of a same side of the first main part, the distal end of one first arm of the second resonating portion is perpendicularly connected to the first resonating portion, the third resonating portion extends away from the distal end of another first arm of the second resonating portion, the fourth resonating portion is perpendicularly connected to the distal end of the third resonating portion and parallel to the metal unit, the fifth resonating portion comprises a longitudinal second main part and two horizontal second arms respectively perpendicularly connected to two ends of a same side of the second main part, one second arm of the fifth resonating portion is perpendicularly connected to the distal end of the fourth resonating portion, the sixth resonating portion extends away from the distal end of another second arm of the fifth resonating portion; the first main part is parallel to the first resonating portion and the two first arms are parallel to the metal unit, the third resonating portion is positioned to be collinear with the first resonating portion, the second main part is parallel to the metal unit and the two second arms are parallel to the first resonating portion, the sixth resonating portion is positioned to be collinear with the fourth resonating portion, the resonating unit and the metal unit cooperatively generate a resonance, thereby receiving/sending wireless signals in corresponding frequency bands.

2. The antenna module of claim 1, wherein the ground unit, the feed unit, and the resonating unit are positioned in that order and on the same plane.

3. The antenna module of claim 1, further comprising a first elastic sheet, wherein the ground unit is connected to the circuit board by the first elastic sheet.

4. The antenna module of claim 1, wherein the feed unit is L-shaped and comprises a first feed portion and a second feed portion perpendicular to the first feed portion, an end of the first feed portion is connected to the metal unit.

5. The antenna module of claim 4, wherein the ground portion is parallel to the first feed portion, the ground unit and the second feed portion are positioned at a same side of the first feed portion.

6. The antenna module of claim 4, further comprising a second elastic sheet, wherein an end of the second feed portion is connected to the second elastic sheet, and the feed unit is connected to the feed point by the second elastic sheet.

7. An antenna module, comprising:

a metal unit;

a ground unit, one end of the ground unit connecting to the metal unit; another end of the ground unit being grounded;

a feed unit, the feed unit being L-shaped and comprising a first feed portion and a second feed portion perpendicular to the first feed portion, one end of the first feed portion connecting to the metal unit for feeding signals to the metal unit; and a resonating unit, wherein the resonating unit comprises a first resonating portion, a second resonating portion, a third resonating portion, a fourth resonating portion, a fifth resonating portion, and a sixth resonating portion connected in that order and on the same plane, wherein the first resonating portion is perpendicularly connected to the metal unit, the second resonating portion comprises a horizontal first main part and two longitudinal first arms respectively perpendicularly connected to two ends of a same side of the first main part, the distal end of one first arm of the second resonating portion is perpendicularly connected to the first resonating portion, the third resonating portion extends away from the distal end of another first arm of the second resonating portion, the fourth resonating portion is perpendicularly connected to the distal end of the third resonating portion and parallel to the metal unit, the fifth resonating portion comprises a longitudinal second main part and two horizontal second arms respectively perpendicularly connected to two ends of a same side of the second main part, one second arm of the fifth resonating portion is perpendicularly connected to the distal end of the fourth resonating portion, the sixth resonating portion extends away from the distal end of another second arm of the fifth resonating portion; the first main part is parallel to the first resonating portion and the two first arms are parallel to the metal unit, the third resonating portion is positioned to be collinear with the first resonating portion, the second main part is parallel to the metal unit and the two second arms are parallel to the first resonating portion, the sixth resonating portion is positioned to be collinear with the fourth resonating portion.

8. The antenna module of claim 7, wherein the metal unit is a metal housing or a metal sidewall of the wireless communication device.

9. The antenna module of claim 7, further comprising a first elastic sheet, wherein the ground unit is connected to the circuit board by the first elastic sheet.

10. The antenna module of claim 7, further comprising a second elastic sheet, wherein an end of the second feed portion is connected to the second elastic sheet, and the feed unit is connected to the feed point by the second elastic sheet.

11. An antenna module applying in a wireless communication device, the antenna module comprising:

a metal unit, the metal unit being a metal housing or a metal sidewall of the wireless communication device;

a ground unit, one end of the ground unit connecting to the metal unit; another end of the ground unit being grounded;

a feed unit, one end of the feed unit connecting to the metal unit; and a resonating unit, wherein the resonating unit comprises a first resonating portion, a second resonating portion, a third resonating portion, a fourth resonating portion, a fifth resonating portion, and a sixth resonating portion connected in that order and on the same plane, wherein the first resonating portion is perpendicularly connected to the metal unit, the second resonating portion comprises a horizontal first main part and two longitudinal first arms respectively perpendicularly connected to two ends of a same side of the first main part, the distal end of one first arm of the second resonating portion is perpendicularly connected to the first resonating portion, the third resonating portion extends away from the distal end of another first arm of the second resonating portion, the fourth resonating portion is perpendicularly connected to the distal end of the third resonating portion and parallel to the metal unit, the fifth resonating portion comprises a longitudinal second main part and two horizontal second arms respectively perpendicularly connected to two ends of a same side of the second main part, one second arm of the fifth resonating portion is perpendicularly connected to the distal end of the fourth resonating portion, the sixth resonating portion extends away from the distal end of another second arm of the fifth resonating portion; the first main part is parallel to the first resonating portion and the two first arms are parallel to the metal unit, the third resonating portion is positioned to be collinear with the first resonating portion, the second main part is parallel to the metal unit and the two second arms are parallel to the first resonating portion, the sixth resonating portion is positioned to be collinear with the fourth resonating portion, the resonating unit and the metal unit cooperatively generate a resonating, thereby receiving/sending wireless signals in corresponding frequency bands.

* * * * *